US007077380B2

(12) United States Patent
Uemura et al.

(10) Patent No.: US 7,077,380 B2
(45) Date of Patent: Jul. 18, 2006

(54) CAPACITY CONTROL DRIVE

(75) Inventors: Norio Uemura, Takahashi (JP); Toshiaki Iwa, Takahashi (JP); Katsuya Shirai, Takahashi (JP); Keigo Shirafuji, Takahashi (JP); Yukihiko Taguchi, Isesaki (JP)

(73) Assignees: Eagle Industry Co., Ltd., Tokyo (JP); Sanden Corporation, Gunma (JP)

( * ) Notice: Subject to any disclaimer, the term of this patent is extended or adjusted under 35 U.S.C. 154(b) by 8 days.

(21) Appl. No.: 10/921,220

(22) Filed: Aug. 19, 2004

(65) Prior Publication Data

US 2005/0040356 A1 Feb. 24, 2005

(30) Foreign Application Priority Data

Aug. 22, 2003 (JP) ..... 2003-298332

(51) Int. Cl.
*F16K 31/02* (2006.01)

(52) U.S. Cl. ..... 251/129.07; 251/129.15; 417/222.2

(58) Field of Classification Search ..... 251/129.07, 251/282; 417/222.2
See application file for complete search history.

(56) References Cited

U.S. PATENT DOCUMENTS 3,471,119 A * 10/1969 Risk ..... 251/84
5,890,876 A * 4/1999 Suito et al. ..... 417/213
6,213,445 B1 * 4/2001 Sato et al. ..... 251/48

FOREIGN PATENT DOCUMENTS

JP 11218078 8/1999

* cited by examiner

*Primary Examiner*—Edward K. Look
*Assistant Examiner*—John K. Fristoe, Jr.
(74) *Attorney, Agent, or Firm*—Baker Botts, LLP

(57) ABSTRACT

A capacity control valve is inserted in a flow path connecting a discharge chamber and a crank chamber of a variable capacity compressor and provided with a valve unit and a drive unit. The valve unit has a valve element for opening/closing the flow path or a valve passage of the valve unit. The drive unit has a movable core or plunger for driving the valve element and a communicating path that is formed in the plunger and connects chambers located in both sides of the plunger.

11 Claims, 4 Drawing Sheets

CAPACITY CONTROL DRIVE

This Nonprovisional application claims priority under 35 U.S.C. § 119(a) on Patent Application No. 2003-298332 filed in Japan on Aug. 22, 2003, the entire contents of which are hereby incorporated by reference.

BACKGROUND OF THE INVENTION

1. Field of the Invention

The present invention relates to a capacity control valve, and more particularly to a capacity control valve for controlling discharge capacity of a variable capacity compressor provided to a vehicle air conditioner.

2. Description of the Related Art

The variable capacity compressor disclosed for example in Unexamined Japanese Patent Publication No. 11-218078 is provided with a capacity control valve. The capacity control valve comprises a valve member and an electromagnetic drive unit for driving the valve member. The valve member is driven by the electromagnetic drive unit to open/close a valve passage, and the valve passage links the discharge chamber of the compressor to the crank chamber thereof.

The electromagnetic drive unit includes a movable iron core or plunger coupled to the valve member. The plunger is inserted into a cylinder bore defined in the electromagnetic drive unit.

More specifically, the plunger has one end on the valve member side, which partitions the cylinder bore into an inlet chamber, and a refrigerant is made flow from a suction chamber of the compressor into the inlet chamber. The inlet chamber is connected to a pressure-sensitive chamber disposed on the other end side of the plunger, and a bellows is located in the pressure-sensitive chamber. The bellows is expanded/contracted by pressure of the suction chamber and mechanically connected to the valve member via the plunger. Therefore, the bellows applies a urging force corresponding to the pressure of the suction chamber to the valve member.

When the solenoid of the electromagnetic drive unit is excited, the valve member is driven by the solenoid in the closing direction thereof. Thus, the opening of the valve member, namely the pressure of the crank chamber, is adjusted by the driving force of the solenoid and the urging force of the bellows.

Since the plunger forms the inlet chamber as mentioned, the one end face of the plunger receives the pressure of the suction chamber and is exposed to the refrigerant. As a result, the atomized lubricating oil that is mixed into the refrigerant is liquefied in the inlet chamber, and the liquefied lubricating oil intrudes into a gap between the plunger and the inner peripheral surface of the cylinder bore.

The gap is extremely narrow, so that the lubricating oil that has intruded into the gap increases the sliding resistance of the plunger due to its viscosity. In the worst case, the gap is blocked up with the lubricating oil, which causes the chamber located on the other end side of the plunger to be sealed in an airtight manner. In this case, even though the electromagnetic force of the solenoid is changed in some measure, the plunger remains being jammed, thereby hindering the smooth opening/closing operation of the valve member. This destabilizes pressure adjustment in the crank chamber, that is, the discharge capacity control of the compressor.

SUMMARY OF THE INVENTION

An object of the present invention is to provide a capacity control valve in which smooth opening/closing operation of a valve member thereof is secured even when the capacity control valve is applied to a variable capacity compressor for a vehicle air conditioner.

To accomplish the above object, a capacity control valve according to the present invention comprises: a valve unit to be inserted in a flow path of a working fluid, the valve unit including a valve passage for connecting an upstream-side portion and a downstream-side portion of the flow path and a valve member for opening/closing the valve passage; and a drive unit for driving the valve member, the drive unit including a nonmagnetic core guide, a movable core slidably disposed in the core guide, the movable core partitioning the inside of the core guide into a first chamber in an airtight state and a second chamber in a state where inflow of the working fluid is unavoidable, at both sides of the movable core in view of an axial direction thereof, a solenoid assembly for generating an electromagnetic force to move the movable core in a closing direction of the valve member, a transmission member for mechanically transmitting the movement of the movable core to the valve member, and a communicating path formed in at least one of the movable core and core guide, and making the first and second chambers communicate with each other.

With the above capacity control valve, the first and second chambers communicate with each other via the communicating path, so that it is possible to avoid the airtight state of the first chamber. Therefore, the movable core can slides smoothly in the core guide. This improves response of the movable core to the electromagnetic force of the solenoid assembly and secures stabilized opening/closing operation of the valve unit.

Specifically, in a case that the capacity control valve is applied to a variable capacity compressor for a vehicle air conditioner, a refrigerant as the working fluid contains lubricating oil. If the lubricating oil flows into a gap between the movable core and an inner peripheral surface of the core guide, the lubricating oil that has intruded in acts as a sealing oil film that brings the first chamber into an airtight state. Due to the communicating path provided to the movable core, however, the first chamber does not fall into the airtight state.

More specifically, the movable core has a sliding peripheral portion that is formed in a part of the movable core in view of the axial direction thereof and slides on an inner peripheral surface of the core guide, and the residual peripheral portion in a non-contact state with respect to the inner peripheral surface of the core guide. In this case, it is preferable that the movable core include a large-diameter portion located on one end of the first chamber side and serving as the sliding peripheral portion and a small-diameter portion extending from the large-diameter portion to the other end located on the second chamber side and being smaller than the large-diameter portion as the residual peripheral portion.

The movable core slides on the inner peripheral surface of the core guide only by the sliding peripheral portion thereof, thereby drastically reducing the sliding resistance of the movable core and securing the smooth sliding motion of the movable core. Even if the lubricating oil enters into a gap between the sliding peripheral portion of the movable core and the inner peripheral surface of the core guide, the lubricating oil is immediately discharged to the small-diameter portion side of the movable core by a pressure increase in the first chamber when the movable core moves to the first chamber side.

Moreover, since an annular space is formed between the small-diameter portion of the movable core and the inner peripheral surface of the core guide, the annular space is usable as a part of the communicating path.

In other words, the communicating path further includes an internal passage formed in the movable core, and the internal passage has one end that opens into the annular space and the other end into the first chamber. Specifically, the internal passage has an axial hole that opens into the first chamber and a radial hole that connects the axial hole and the annular space to each other.

If the lubricating oil flows into the first chamber, the internal passage rapidly discharges the lubricating oil in the first chamber through the annular space into the second chamber.

Furthermore, the communicating path preferably includes at least one axial groove formed in an outer peripheral surface of the movable core. The axial groove makes the first and second chambers communicate with each other and reliably prevents the first chamber from falling into the airtight state.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings that are given by way of illustration only, and thus, are not limitative of the present invention, and wherein.

DETAILED DESCRIPTION OF THE PREFERRED EMBODIMENTS

Figure 1:
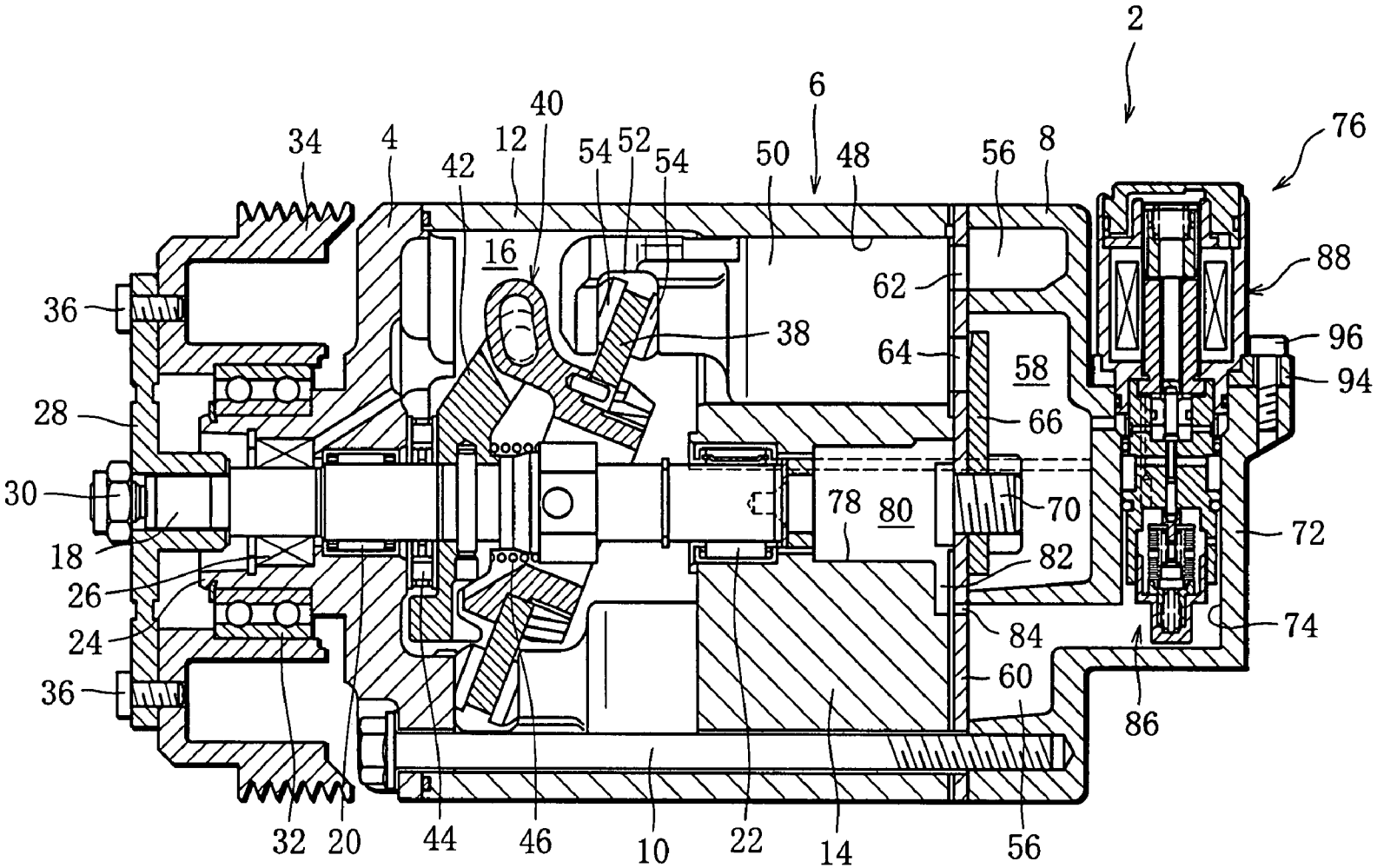
FIG. 1 is a longitudinal sectional view of a variable capacity compressor having a capacity control valve.

A variable capacity compressor shown in FIG. 1 is incorporated in a vehicle air conditioner or the like, compresses a gaseous refrigerant serving as a working fluid, and supplies the compressed refrigerant through a refrigerant-circulating path of the air conditioner to a condenser. The refrigerant of this type contains atomized lubricating oil, and such lubricating oil is used for lubricating various kinds of movable members in the compressor.

The compressor is provided with a cylindrical housing 2. The housing 2 includes a front casing 4, a center casing 6 and a rear casing 8, and the casings are coupled to one another by a plurality of coupling bolts 10.

The center casing 6 has a hollow cylinder shell 12 extending from a front end plate 4 and a cylinder block 14 located between the cylinder shell 12 and the rear casing 8. The cylinder shell 12 and the cylinder block 14 are integrally formed, and the cylinder shell 12 defines a crank chamber 16 therein.

A drive shaft 18 is concentrically disposed in the crank chamber 16. The drive shaft 18 is rotatably supported by the front casing 4 and the cylinder block 14 through bearings 20 and 22, respectively.

As is apparent from FIG. 1, the front casing 4 has a boss 24. The boss 24 protrudes outward, and a sealing member 26 is arranged in the inside of the boss 24. The drive shaft 18 has one end portion penetrating the sealing member 26 and sticks out from the boss 24.

A power transmission disc 28 is spline-engaged with the one end or projecting end of the drive shaft 18. The spline engagement causes the drive shaft 18 and the power transmission disc 28 to rotate integrally. The projecting end of the drive shaft 18 had a male thread in an outer peripheral surface thereof, and a nut 30 is fastened to the male thread. The nut 30 prevents the power transmission disc 28 from moving in an axial direction thereof with respect to the drive shaft 18.

A pulley 34 is rotatably supported by an outer peripheral surface of the boss 24 through a bearing 32. The pulley 34 is coupled to an outer peripheral edge of the power transmission disc 28 by a plurality of coupling bolts 36. When being rotated, the pulley 34 makes the drive shaft 18 rotate in the same direction through the power transmission disc 28.

In cases where the compressor is applied to the vehicle air conditioner, the pulley 34 is driven by a vehicle engine through an endless drive belt.

There is arranged a swash plate 38 in the crank chamber 16, and the swash plate 38 is coupled to the drive shaft 18 through a coupler 40 and a rotor 42. The rotor 42 is mounted on the drive shaft 18 to rotate integrally with the drive shaft 18. The rotor 42 is rotatably supported by an inner end surface of the front casing 4 through a thrust bearing 44.

The coupler 40 is engaged with the rotor 42 to allow the swash plate 38 to incline. Disposed between the rotor 42 and the coupler 40 is a compression coil spring 46. The compression coil spring 46 surrounds the drive shaft 18 and presses the coupler 40 toward the cylinder block 14. Accordingly, the swash plate 38 is urged by the compression coil spring 46 in such a direction that the swash plate 38 has a perpendicular posture to the drive shaft 18.

The cylinder block 14 has a plurality of cylinder bores 48, and the cylinder bores 48 are arranged around an axis of the drive shaft 18 at regular intervals. Pistons 50 are inserted into the cylinder bores 48, respectively. Each piston 50 has one end formed into a shoe retainer 52, and the other end of the piston 50 partitions the corresponding cylinder bore 48 into a compression chamber.

The shoe retainer 52 protrudes from the cylinder block 14 into the crank chamber 16 and holds a pair of shoes 54 in the inside thereof. The shoes 54 slidably hold an outer peripheral edge of the swash plate 38. Therefore, when the swash plate 38 is rotated with the drive shaft 18, the rotation of the swash plate 38 is converted into reciprocating motion of each piston 50, and a reciprocating stroke of the piston 50 is determined by an inclination angle of the swash plate 38.

The rear casing 8 defines a suction chamber 56 and a discharge chamber 58 therein, respectively. More specifically, the discharge chamber 58 is positioned at the center of the rear casing 8 and connected to the condenser of the vehicle air conditioner. The suction chamber 56 is formed in an annular shape that surrounds the discharge chamber 58, and is connected to an evaporator of the conditioner through the refrigerant-circulating path.

Sandwiched between the cylinder block 14 and the rear casing 8 is a valve plate 60. The valve plate 60 has a suction hole 62 and a discharge hole 64 for each cylinder bore 84, that is, for each compression chamber. Further attached to the valve plate 60 are a suction valve and a discharge valve for opening/closing the suction hole 62 and the discharge hole 64, respectively.

Although the suction and discharge valves are not shown in FIG. 1, the suction and discharge valves are each formed of a reed valve, and are opened/closed in response to the reciprocating motion of the corresponding pistons 50, that is, increase and decrease of volume of the corresponding compression chambers. For this reason, the processes of sucking, compressing and discharging the refrigerant are continuously performed in each compression chamber while the drive shaft 18 rotates. In FIG. 1, only a valve retainer 66 for restricting the maximum opening of the discharge valve is illustrated. The valve retainer 66 is attached to the valve plate 60 by a mounting bolt 70, along with the suction and discharge valves.

A bulge portion 72 is integrally formed in the rear casing 8 so as to protrude outside. The bulge portion 72 has a cylindrical valve-fitting hole 74. The valve-fitting hole 74 extends in a direction perpendicular to the axial direction of the drive shaft 18, namely in a vertical direction. An upper end of the valve-fitting hole 74 is open, and a lower end thereof opens into the suction chamber 56.

Fitted into the valve-fitting hole 74 is a capacity control valve 76. The control valve 76 has a function of controlling an inflow amount of the refrigerant from the discharge chamber 58 into the crank chamber 16, whereby pressure in the crank chamber 16 is varied by the control valve 76. The pressure in the crank chamber 16 determines the inclination angle of the swash plate 38, namely reciprocating strokes of the pistons 50, thereby controlling the capacity of the compressor.

The cylinder block 14 has a center bore 78 for the bearing 22, and the bearing 22 is located in one end of the center bore 78. The center bore 78 forms a chamber 80 between the bearing 22 and the valve plate 60. Further, the cylinder block 14 has a cut 82 outwardly extending from the chamber 80 in the radial direction thereof along the valve plate 60. The valve plate 60 is provided with an orifice 84 for connecting the cut 82 and the suction chamber 56 to each other. Therefore, the crank chamber 16 is connected to the suction chamber 56 via an internal passage of the bearing 22, the chamber 80, the cut 82 and the orifice 84.

Figure 2:
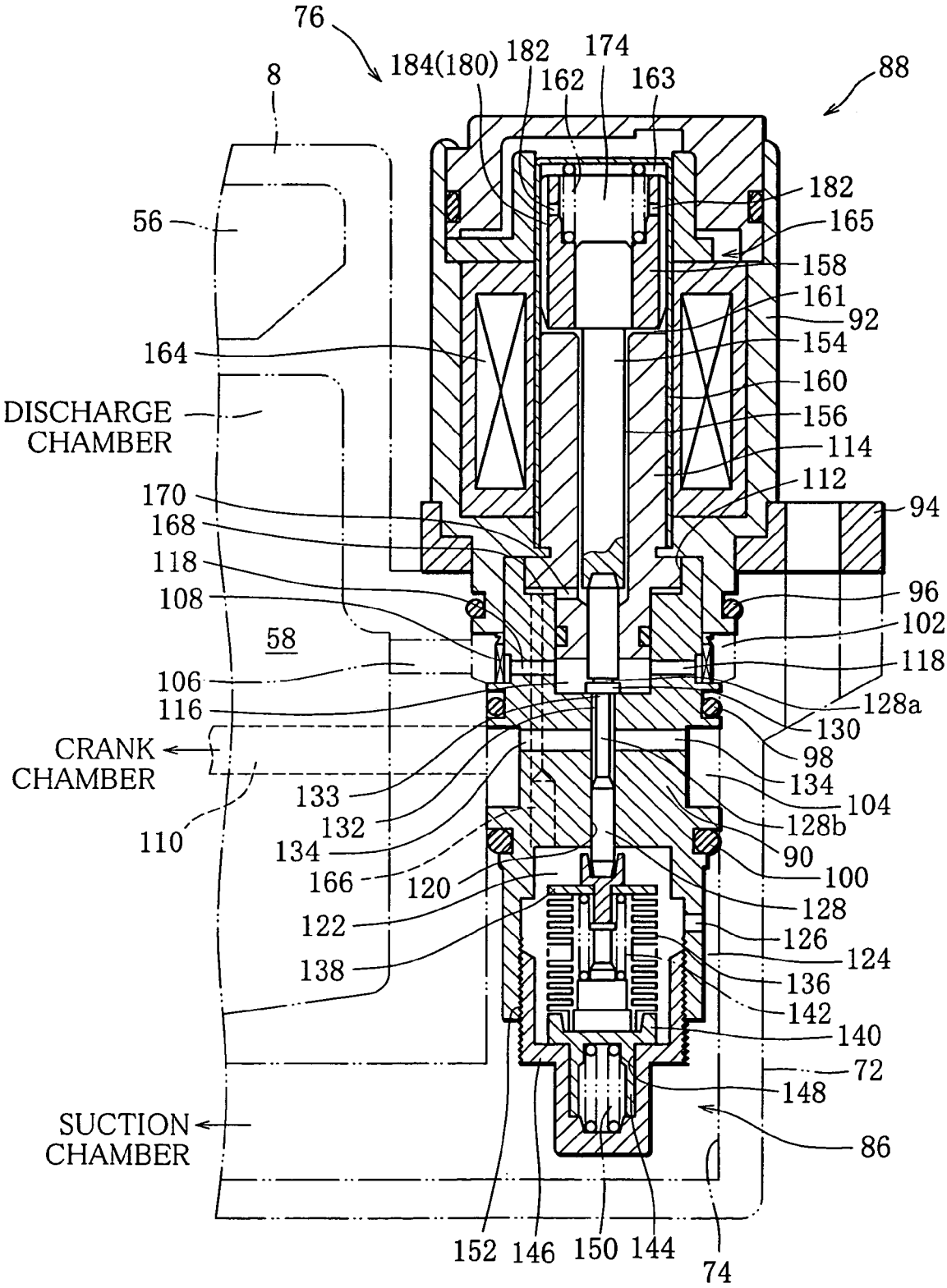
FIG. 2 is an enlarged view of the capacity control valve of FIG. 1.

FIG. 2 shows the details of the capacity control valve 76.

The control valve 76 generally includes a valve unit 86 and an electromagnetic drive unit 88, and the valve unit 86 is accommodated in the valve-fitting hole 74. More specifically, the units 86 and 88 have a valve casing 90 and a solenoid casing 92, respectively. The casings 90, 92 are each formed in a cylindrical shape and joined to each other such that an upper end of the valve casing 90 is interfitted with a lower end of the solenoid casing 92 as illustrated in FIG. 2.

The lower end of the solenoid casing 92 is inserted into the valve-fitting hole 74 with the valve casing 90. The solenoid casing 92 has a fixing flange 94 outside the valve-fitting hole 74. The control valve 76 is seated in the bulge portion 72 of the rear casing 8 by the fitting flange 94 and a bolt 96 (refer to FIG. 1).

There is disposed an O-ring 96 between the lower end of the solenoid casing 92 and an inner peripheral surface of the valve-fitting hole 74. O-rings 98 and 100 are also vertically arranged between an upper portion of the valve casing 90 and the inner peripheral surface of the valve-fitting hole 74.

Outside the valve casing 90, there is formed an annular chamber 102 between the O-rings 96 and 98, and an annular chamber 104 between the O-rings 98 and 100. The upper annular chamber 102 communicates with the discharge chamber 58 via a communication hole 106 and has a filter 108 therein. The communication hole 106 is formed in a partition wall of the rear casing 8. The partition wall separates the discharge chamber 58 and the valve-fitting hole 74.

The lower annular chamber 104 communicates with the crank chamber 16 via a communicating passage 110. The communicating passage 110 is either formed in the housing 2 of the compressor or formed of a pipe extending outside the housing 2.

There is formed a stepped hole 112 in the upper portion of the valve casing 90, and the stepped hole 112 is opened in the upper end of the valve casing 90. A fixed core 114 of the electromagnetic drive unit 88 is inserted into the stepped hole 112 through a seal. That is, the fixed core 114 is formed into a cylindrical shape and has a lower end portion with a step, which fits into the stepped hole 112, the lower end portion being formed as a plug that blocks up the upper end of the stepped hole 112.

The lower end of the fixed core 114 forms a valve chamber 116 in the stepped hole 112. The valve chamber 116 is connected to the upper annular chamber 102 through a plurality of inlet ports 118, and the inlet ports 118 are formed in the valve casing 90. Accordingly, the valve chamber 116 is constantly connected to the discharge chamber 58 through the inlet ports 118, the annular chamber 102, the filter 108 and the communication hole 106, to thereby receive the pressure of the discharge chamber 58, namely a discharge pressure of the refrigerant. The filter 108 prevents foreign substances from flowing from the discharge chamber 58 into the valve chamber 116.

A stem hole 120 is formed concentrically in the valve casing 90 to extend from the valve chamber 116 to a pressure-sensitive chamber 122. The pressure-sensitive chamber 122 is formed in the lower end portion of the valve casing 90 and connected to the suction chamber 56.

More specifically, the lower end portion of the valve casing 90 is formed into a stepped portion tapering toward the bottom of the valve-fitting hole 74. Therefore, there is secured an annular space 124 between the lower end portion of the valve casing 90 and the inner peripheral surface of the valve-fitting hole 74. Furthermore, the valve casing 90 is provided with a hole 126 for connecting the annular gap 124 and the pressure-sensitive chamber 122. This allows the pressure-sensitive chamber 122 to receive the pressure in the suction chamber 56 (valve-fitting hole 74), or a suction pressure of the refrigerant, through the annular space 124 and the hole 126.

A valve stem 128 is slidably inserted into the stem hole 120. The valve stem 128 extends upward passing through the valve chamber 116, and an upper end portion of the valve stem 128 is slidably inserted into the lower end portion of the fixed core 114. The lower end of the valve stem 128 protrudes into the pressure-sensitive chamber 122.

There is disposed a valve element 130 in the valve chamber 116, the valve element 130 being integrally formed on the valve stem 128. Specifically, the valve element 130 is formed as a flange provided to the valve stem 128. The valve stem 128 has small-diameter portions **128*a* and 128*b* arranged above and below the valve element 130**, respectively.

The lower small-diameter portion 128*b* extends toward the pressure-sensitive chamber 122 by a given length, to thereby form an annular valve passage 132 between the valve stem 128 and an inner peripheral surface of the stem hole 120. The valve passage 132 therefore has an upper end formed as a valve port 133 that is opened/closed by the valve element 130, and the valve port 133 has a valve seat for the valve element 130 in an outer peripheral edge thereof.

The small-diameter portions 128*a* and 128*b* have identical outer diameters, and the valve stem 128 has substantially the same pressure-receiving area at both axial sides thereof. Therefore, the discharge pressure in the valve chamber 116 does not virtually act on the valve stem 128 in a direction of closing the valve element 130.

Further, a plurality of outlet ports 134 is formed in the valve casing 90 so that the outlet ports 134 connect the valve passage 132 and the annular chamber 104. Accordingly, the valve passage 132 is connected to the crank chamber 16 through the outlet ports 134, the annular chamber 104 and the communicating passage 110.

There is disposed a bellows 136 in the pressure-sensitive chamber 122. The bellows 136 has an upper seat 138 and a lower seat 140 and is formed such that the inside thereof functions as a vacuum chamber. In the vacuum chamber, a bellows spring 142 is arranged between the upper seat 138 and the lower seat 140. The bellows spring 142 is formed of a compression coil spring and urges the bellows 136 in an extending direction.

Extending outward from the lower seat 140 is a hollow cylindrical guide 144. The cylindrical guide 144 is slidably fitted into a guide hole 148 or a cap 146. The cap 146 forms a part of the valve casing 90, that is, the bottom of the pressure-sensitive chamber 122.

Moreover, a valve spring 150 is accommodated in the guide hole 148. The valve spring 150 is also formed of a compression coil spring and arranged between the lower seat 140 and the bottom of the guide hole 148. The valve spring 150 presses the bellows 136 upward, to thereby bring the upper seat 138 of the bellows 136 into contact with the lower end of the valve stem 122. Consequently, the valve spring 150 urges the valve element 130 in an opening direction through the bellows 136 and the valve stem 122. As is clear from FIG. 2, the cap 146 is screwed into a female thread 152 of the valve casing 90.

The fixed core 114 has a center hole at the center thereof. The center hole extends coaxially with the valve stem 128 through the fixed core 114. Fitted in the center hole is a drive rod 154, and a given gap 156 is secured between the drive rod 154 and the inner peripheral surface of the center hole. Therefore, the drive rod 154 is in a non-contact state with respect to the fixed core 114.

The drive rod 154 has an upper end portion projecting upward from the fixed core 114 and having a slightly larger diameter than that of the center hole. An iron plunger 158 serving as a movable core is mounted on the upper end portion of the drive rod 154. The plunger 158 has a cylindrical shape and is located coaxially with the fixed core 114.

The fixed core 114 and the plunger 158 are surrounded by a plunger guide 160 made of a nonmagnetic material. The plunger guide 160 is formed into a hollow cylinder and has a closed upper end and an open lower end. The lower end of the plunger guide 160 is fastened to the solenoid casing 92.

Between the upper end of the plunger guide 160 and the fixed core 114, there is secured a space for allowing the plunger 158 to move in an axial direction. The plunger guide 160 has an inner diameter substantially identical to an outer diameter of the fixed core 114 and that of the plunger 158. Therefore, when the plunger 158 moves in the axial direction, the plunger 158 slides on an inner peripheral surface of the plunger guide 160. The plunger 158 divides the space into a chamber 161 between the plunger 158 and the fixed core 114 and a chamber 163 between the upper end of the plunger guide 160 and the plunger 158.

There is disposed a plunger spring 162 in the chamber 161, that is, between the upper end of the plunger guide 160 and the plunger 158. The plunger spring 162 is formed of a compression coil spring and presses the plunger 158 downward. Thus, the drive rod 154 is also pressed downward with the plunger 158, and the lower end of the drive rod 154 is brought into contact with the upper end of the valve stem 128 as illustrated in FIG. 2. More specifically, a female taper hole is formed in the lower end of the drive rod 154, and the upper end of the valve stem 128 is formed as a male taper end corresponding to the female taper hole of the drive rod 154. Consequently, the male taper end of the valve stem 128 is fitted into the female taper hole of the drive rod 154.

Accommodated in the solenoid casing 92 is a solenoid assembly 165, and the solenoid assembly 165 has a solenoid 164 that surrounds the plunger guide 160. When being excited, the solenoid 164 provides an electromagnetic force to the plunger 158. The electromagnetic force acts to press down the plunger 158, thereby pressing the valve stem 128 downward through the drive rod 154 of the plunger 158 while resisting the urging force of the valve spring 150 and bellows 138. Therefore, the valve element 130 is closed as shown in FIG. 2.

The closing of the valve element 130 blocks off the passages 106, 102, 118, 116, 132, 134, 104 and 110 connecting the discharge chamber 58 and the crank chamber 16. As a result, the refrigerant is not supplied from the discharge chamber 58 to the crank chamber 16, and the refrigerant in the crank chamber 16 is discharged into the suction chamber 56. This reduces the pressure in the crank chamber 16 and increases the reciprocating strokes of the pistons 50, or the discharge amount of the compressor.

The increase of the discharge amount causes pressure in the suction chamber 58 or the pressure-sensitive chamber 122 to decrease. The bellows 136 then expands, thereby increasing the urging force of the bellows 136, which acts in the direction of opening the valve element 130. Therefore, the opening of the valve element 130 is determined by the electromagnetic force and the pressure in the suction chamber 58.

Since the cap 146 is screwed into the female thread 152 of the valve casing 90 as mentioned above, a preset load of the bellows 136, namely the bellows spring 142 located therein, can be adjusted by varying a screwing stroke of the cap 146. Accordingly, the pressure in the suction chamber 56 which controls the opening of the valve element 130 is primarily determined by an electric current value supplied to the solenoid 164 virtually without being affected by the discharge pressure.

When the solenoid 164 is excited, the valve element 130 is opened by receiving the urging force of the valve spring 150 and bellows 136. In this case, the refrigerant is supplied from the discharge chamber 58 through the above-mentioned passages to the crank chamber 16, thereby raising the pressure in the crank chamber 16. As a result, the reciprocating strokes of the pistons 50, namely the discharge amount of the compressor, is reduced.

The urging force of the valve spring 150 is adequately greater than that of the plunger spring 162. For this reason, even if the bellows 136 is in a completely contracted state, once the solenoid 164 is demagnetized, the valve element 130 is forcibly opened, which minimizes the discharge amount of the compressor.

As illustrated in FIG. 2, the pressure-sensitive chamber 122 and the gap 156 in the fixed core 114 are connected to each other through a connecting path. More specifically, the connecting path includes an axial passage 166 formed in the valve casing 90, and the axial passage 166 extends from the pressure-sensitive chamber 122 to an annular chamber 168 located in the upper end side of the valve casing 90. The annular chamber 168 is formed between the valve casing 90 and the fixed core 114. Further formed in the fixed core 114 is a radial hole 170 for connecting the annular chamber 168 and the gap 156. Therefore, the refrigerant in the pressure-sensitive chamber 122 flows through the connecting path into the gap 156 and then flows from the gap 156 into the chamber 161 of the plunger guide 160.

The high-pressure refrigerant in the valve chamber 116 also leaks out into the gap 156 through a gap between the valve stem 128 and the inner peripheral surface of the center hole in the fixed core 114. However, a leakage amount of such a high-pressure refrigerant is extremely small, so that the pressure in the gap 156 is not affected by the leakage of the high-pressure refrigerant. Moreover, the high-pressure refrigerant that has leaked out into the gap 156 flows through the connecting path into the pressure-sensitive chamber 122 and is then returned from the pressure-sensitive chamber 122 to the suction chamber 56.

Figure 3:
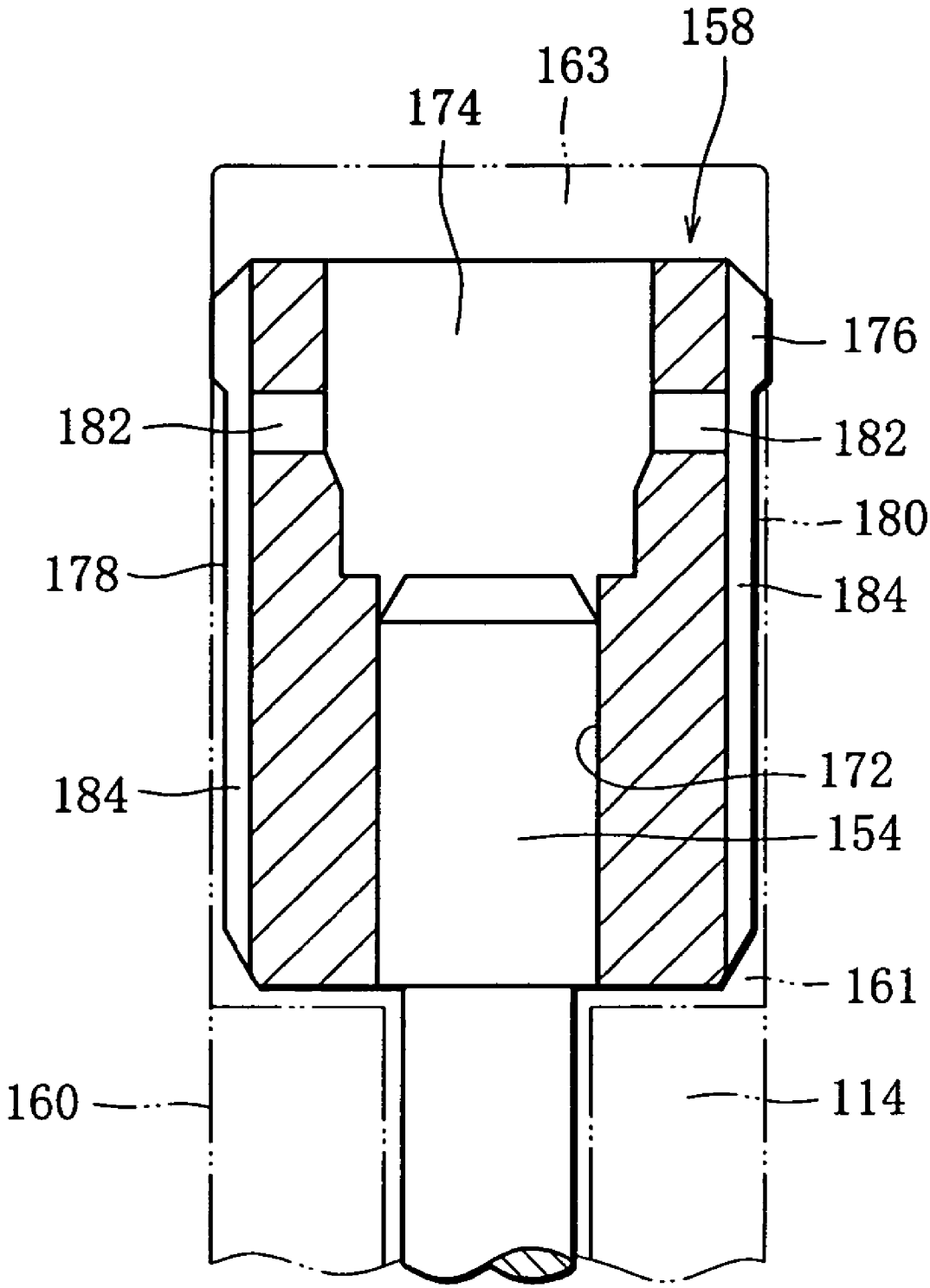
FIG. 3 is an enlarged view of a plunger of FIG. 2.

FIG. 3 is an enlarged view of the plunger 158.

The plunger 158 has a through-hole 172 at the center thereof. The upper end portion of the drive rod 154 is inserted into a lower end portion of the through-hole 172, and the drive rod 154 is integrally joined to the plunger 158.

An upper portion of the through-hole 172 is formed as a spring-housing chamber 174 that communicates with the chamber 163 of the plunger guide 160, and the plunger spring 162 is accommodated in the spring-housing chamber 174.

The plunger 158 has a large-diameter portion 176 in an upper end thereof and slides on the inner peripheral surface of the plunger guide 160 only by the large-diameter portion 176. More specifically, the plunger 158 has a small-diameter portion 178 having a smaller diameter than the large-diameter portion 176 in a lower side of the large-diameter portion 176. There is secured an annular space 180 between an outer peripheral surface of the small-diameter portion 178 and the inner peripheral surface of the plunger guide 160.

In the axial direction of the plunger 158, the large-diameter portion 176 is adequately short, compared to the small-diameter portion 178, and the plunger 158 has small sliding resistance. In addition, it is desirable that the annular space 180 be as small as possible in order to avoid affecting a magnetic circuit formed between the fixed core 114 and the plunger 158.

Further, a pair of radial holes 182 is formed in the small-diameter portion 178 of the plunger 158. The radial holes 182 are located separately from each other in the diametral direction of the plunger 158 and connect the spring-housing chamber 174 and the annular space 180 to each other. Specifically, the annular holes 182 are positioned adjacent to the large-diameter portion 176.

The annular space 180 and the radial holes 182 connect the chambers 161 and 163 in the plunger guide 160, so that the chamber 163 is never brought into an airtight state. Thus, even if the refrigerant flows from the gap 154 in the fixed core 114 through the chamber 161 and the annular space 180 to enter in between the large-diameter portion 176 of the plunger 158 and the inner peripheral surface of the plunger guide 160, the chamber 163 does not fall into the airtight state due to the lubricating oil contained in the refrigerant. This makes it possible to smoothly move the plunger 158 and to assure the reliable opening/closing operation of the valve member 130.

Figure 4:
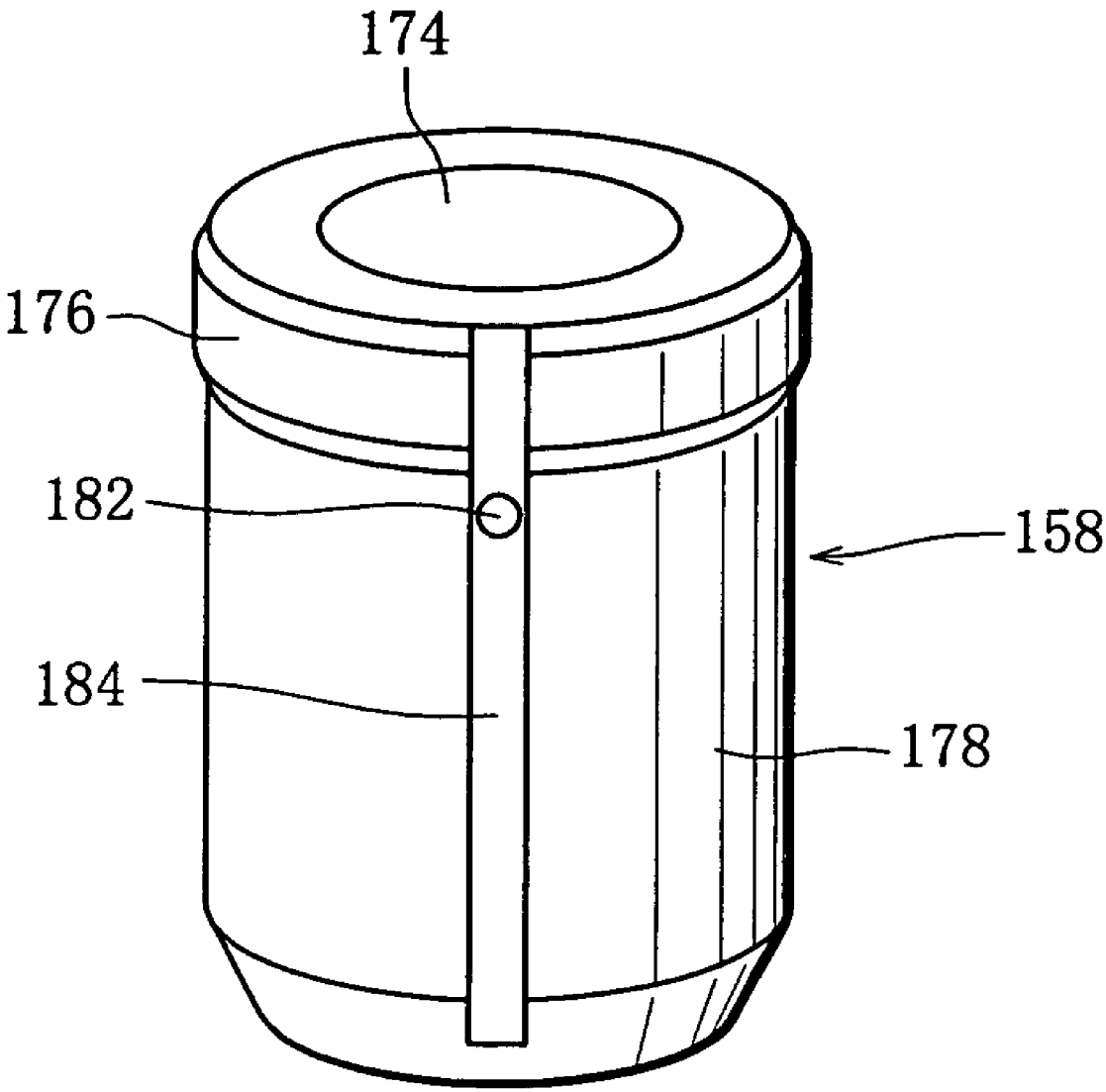
FIG. 4 is a perspective view of the plunger of FIG. 3.

Furthermore, as is obvious from FIG. 4, there is formed a pair of axial grooves 184 in the outer peripheral surface of the plunger 158. The axial grooves 184 extend from the upper end surface of the plunger 158 to the tapered lower end portion of the plunger 158. The radial holes 182 are opened in the corresponding bottoms of the axial grooves 184.

The axial grooves 184 increase a cross-sectional area of the passages connecting the chambers 161 and 163 to each other. Additionally, one or more than two axial grooves may be provided.

Further, the passages connecting the chambers 161 and may be formed in the plunger guide 160.

What is claimed is:

1. A capacity control valve comprising:

a valve unit to be inserted in a flow path of a working fluid, said valve unit including a valve passage for connecting an upstream-side portion and a downstream-side portion of the flow path and a valve member for opening/closing said valve passage; and a drive unit connected with said valve unit and driving said valve member, said drive unit including:

a nonmagnetic core guide extending in a driving direction of said valve member, a movable core slidably disposed in said core guide, said movable core partitioning the inside of said core guide into a first chamber in an airtight state and a second chamber at both sides of said movable core in view of an axial direction thereof, respectively, the second chamber being located at the side of said valve unit, a solenoid assembly for generating an electromagnetic force to move said movable core in a closing direction of said valve member, a transmission member for mechanically transmitting the movement of said movable core to said valve member, and a communicating path formed in at least one of said movable core and said core guide, and making said first and second chambers communicate with each other, wherein said movable core has a sliding peripheral portion that is formed in a part of said movable core in view of the axial direction thereof and slides on an inner peripheral surface of said core guide, and a residual peripheral portion in a non-contact state with respect to the inner peripheral surface of said core guide, and said communication path comprises an annular space formed between the residual peripheral portion and an inner peripheral surface of said core guide.

2. The valve according to claim 1, wherein said communication path further includes an axial hole that opens into the first chamber and a radial hole that connects the axial hole and the annular space.

3. The valve according to claim 2, wherein said communication path further includes an axial groove formed in an outer peripheral surface of said movable core, said axial groove placing said first and second chambers in communication with each other.

4. A capacity control valve comprising:

a valve unit to be inserted in a flow path of a working fluid, said valve unit including a valve passage for connecting an upstream-side portion and a downstream-side portion of the flow path and a valve member for opening/closing said valve passage; and a drive unit connected with said valve unit and driving said valve member, said drive unit including:

a nonmagnetic core guide extending in a driving direction of said valve member, a movable core slidably disposed in said core guide, said movable core partitioning the inside of said core guide into a first chamber in an airtight state and a second chamber at both sides of said movable core in view of an axial direction thereof, respectively, the second chamber being located at the side of said valve unit, a solenoid assembly for generating an electromagnetic force to move said movable core in a closing direction of said valve member, a transmission member for mechanically transmitting the movement of said movable core to said valve member, and a communicating path formed in at least one of said movable core and said core guide, and making said first and second chambers communicate with each other, wherein said movable core has a sliding peripheral portion that is formed in a part of said movable core in view of the axial direction thereof and slides on an inner peripheral surface of said core guide, and a residual peripheral portion in a non-contact state with respect to the inner peripheral surface of said core guide, and, wherein said movable core includes a large-diameter portion located on one end of the first chamber side and serving as the sliding peripheral portion and a small-diameter portion extending from the large-diameter portion located on the other end of the second chamber side and being smaller than the large-diameter portion as the residual peripheral portion, and wherein said communicating path includes an annular space formed between an outer peripheral surface of said small-diameter portion and the inner peripheral surface of said core guide.

5. The valve according to claim 4, wherein said communicating path further includes at least one axial groove formed in an outer peripheral surface of said movable core, said axial groove making the first and second chambers communicate with each other.

6. The valve according to claim 4, wherein said communicating path further includes an internal passage formed in said movable core, the internal passage having one end that opens into the annular space and the other end into the first chamber.

7. The valve according to claim 6, wherein the internal passage has an axial hole that opens into the first chamber and a radial hole that connects the axial hole and the annular space to each other.

8. The valve according to claim 7, wherein said communicating path further includes at least one axial groove formed in an outer peripheral surface of said movable core, the axial groove making the first and second chambers communicate with each other.

9. The valve according to claim 8, wherein the radial hole has one end that is opened in a bottom of the axial groove.

10. The valve according to claim 4, wherein the flow path connects a discharge chamber and a swash plate chamber of a variable capacity compressor, and wherein the working fluid is a refrigerant containing lubricating oil.

11. The valve according to claim 10, wherein said valve further includes a path connecting the second chamber and a suction chamber of said compressor to each other.

* * * * *